US007270597B2

(12) United States Patent
Svirchevski et al.

(10) Patent No.: US 7,270,597 B2
(45) **Date of Patent: *Sep. 18, 2007**

(54) METHOD AND SYSTEM FOR CHEMICAL MECHANICAL POLISHING PAD CLEANING

(75) Inventors: Julia S. Svirchevski, San Jose, CA (US); Katrina A. Mikhaylich, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/256,293

(22) Filed: Oct. 21, 2005

(65) Prior Publication Data

US 2006/0040595 A1 Feb. 23, 2006

Related U.S. Application Data

(62) Division of application No. 10/000,494, filed on Oct. 30, 2001, now Pat. No. 6,994,611, which is a division of application No. 09/322,198, filed on May 28, 1999, now Pat. No. 6,352,595.

(51) Int. Cl.
*B24B 1/00* (2006.01)

(52) U.S. Cl. ..... 451/56; 451/41; 451/443; 451/444; 438/692; 156/345.12; 134/2; 134/3

(58) Field of Classification Search ..... 451/36, 451/41, 54, 56, 443, 444; 438/692, 693, 438/756; 156/345.11, 345.12; 134/2, 3; 216/52

See application file for complete search history.

(56) References Cited

U.S. PATENT DOCUMENTS 5,725,417 A * 3/1998 Robinson ..... 451/56
6,234,877 B1 * 5/2001 Koos et al. ..... 451/41
6,258,721 B1 * 7/2001 Li et al. ..... 438/693
6,312,319 B1 * 11/2001 Donohue et al. ..... 451/56

* cited by examiner

*Primary Examiner*—Eileen P. Morgan
(74) *Attorney, Agent, or Firm*—Martine Penilla & Gencarella, LLP

(57) ABSTRACT

In one embodiment, a method for cleaning a chemical mechanical polishing (CMP) pad is provided. The CMP pad surface has a residue thereon. Chemicals are applied onto the surface of the CMP pad and the pad surface is rinsed so as to substantially remove by-product produced by the chemicals. A mechanical conditioning operation is performed on the surface of the pad. The wafer surface includes copper and oxide during the CMP operation.

5 Claims, 11 Drawing Sheets

METHOD AND SYSTEM FOR CHEMICAL MECHANICAL POLISHING PAD CLEANING

CROSS-REFERENCE TO RELATED APPLICATION

This Application is a divisional of the U.S. patent application Ser. No. 10/000,494, filed on Oct. 30, 2001, now U.S. Pat. No. 6,994,611 which in turn is a divisional of the U.S. Patent Application Ser. No. 09/322,198 filed May 28, 1999, now U.S. Pat. No. 6,352,595 issued on Mar. 5, 2002. The Patent Application and the Patent are incorporated herein by reference.

BACKGROUND

The present invention relates to chemical mechanical polishing (CMP) techniques and related wafer cleaning and, more particularly, to improved CMP operations.

DESCRIPTION OF THE RELATED ART

In the fabrication of semiconductor devices, there is a need to perform chemical mechanical polishing (CMP) operations and wafer cleaning. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material grows. Without planarization, fabrication of further metallization layers becomes substantially more difficult due to the higher variations in the surface topography. In other applications, metallization line patterns are formed in the dielectric material, and then, metal CMP operations are performed to remove excess metallization. After any such CMP operation, it is necessary that the planarized wafer be cleaned to remove particulates and contaminants.

FIG. 1 shows a schematic diagram of a chemical mechanical polishing (CMP) system 14, a wafer cleaning system 16, and post-CMP processing 18. After a semiconductor wafer 12 undergoes a CMP operation in the CMP system 14, the semiconductor wafer 12 is cleaned in a wafer cleaning system 16. The semiconductor wafer 12 then proceeds to post-CMP processing 18, where the wafer may undergo one of several different fabrication operations, including additional deposition of layers, sputtering, photolithography, and associated etching.

A CMP system 14 typically includes system components for handling and polishing the surface of the wafer 12. Such components can be, for example, an orbital polishing pad, or a linear belt polishing pad. The pad itself is typically made of a polyurethane material. In operation, the belt pad is put in motion and then a slurry material is applied and spread over the surface of the belt pad. Once the belt pad having slurry on it is moving at a desired rate, the wafer is lowered onto the surface of the belt pad. In this manner, wafer surface that is desired to be planarized is substantially smoothed, much like sandpaper may be used to sand wood. The wafer is then sent to be cleaned in the wafer cleaning system 16.

It is important to clean a semiconductor chip after a semiconductor wafer 12 has undergone a CMP operation in a chemical mechanical polishing (CMP) system 14 because particles, particulates, and other residues remain on the surface of the semiconductor wafer 12 after the CMP operation. These residues may cause damage to the semiconductor wafer 12 in further post-CMP operations. The residues may, for example, scratch the surface of the wafer or cause inappropriate interactions between conductive features. Moreover, several identical semiconductor chip dies are produced from one semiconductor wafer 12. One unwanted residual particle on the surface of the wafer during post-CMP processing can scratch substantially all of the wafer surface, thereby ruining the dies that could have been produced from that semiconductor wafer 12. Such a mishaps in the cleaning operation may be very costly.

Better cleaning of the wafer can be achieved in the wafer cleaning system 16 by improving the processes used in the CMP system 14 before the wafer even gets to the wafer cleaning system 16. The CMP system 14 can be improved for the next wafer by conditioning the surface of the belt pad. Pad conditioning is generally performed to remove excess slurry and residue build-up from the clogged belt pad. As more wafers are polished, the belt pad will collect more residue build-up, which can make efficient CMP operations difficult. One well-known method of conditioning the belt pad is to rub the belt pad with a conditioning disk. The conditioning disk typically has a nickel-plated diamond grid or a nylon brush over its surface. The diamond grid is typically used to condition belt pads having a hard surface. In contrast, the nylon brush is typically used to condition belt pads having a softer surface. The conditioning of the belt pad may be done in-situ, where the belt pad is conditioned while the belt pad is polishing the wafer, or ex-situ, where the belt pad is conditioned when the belt pad is not polishing a wafer.

While conditioning disks remove slurry and residue, they inevitably remove some of the belt pad surface. Of course, removal of the belt pad surface exposes a fresh layer of the belt pad, thus increasing the polishing rate during CMP. Unfortunately, removal of the belt pad surface using conditioning methods causes the belt pad to wear out quickly, thereby driving up the cost of running the CMP system 14. On the other hand, if the belt pad is under-conditioned, the life of the belt pad may increase because less of the belt pad is removed. However, residual clogging materials will be left on the belt pad surface. Thus, the belt pad will generally not polish at an efficient rate and the CMP itself will not be of a very high quality.

For the aforementioned reasons, techniques for conditioning the belt pad are an important part of the semiconductor chip fabrication process. There is therefore a need for improved methods of conditioning the belt pad.

SUMMARY

Broadly speaking, the present invention fills these needs by providing an improved method for conditioning a chemical mechanical polishing (CMP) pad and a system for implementing the same. The method involves a chemically treating and mechanically scraping the CMP pad. It should be appreciated that the present invention can be implemented in numerous ways, including as a process, an apparatus, a system, a device, or a method. Several inventive embodiments of the present invention are described below.

In one embodiment, a method for cleaning a chemical mechanical polishing (CMP) pad is provided. The CMP pad has a residue on the surface of the CMP pad. Chemicals are applied onto the surface of the CMP pad and the pad surface is rinsed so as to substantially remove by-product produced by the chemicals. A mechanical conditioning operation is performed on the surface of the pad. The wafer surface includes copper and oxide during the CMP operation.

In another embodiment, another method for cleaning a chemical mechanical polishing (CMP) pad is provided. The CMP pad has a residue on a surface of the CMP pad as a result of performing a CMP operation on the surface of a substrate. The surface of the substrate includes substantially all copper at a beginning of the CMP operation and a combination of oxide and copper near a completion of the CMP operation. Chemicals are applied onto the surface of the CMP pad and the pad surface is rinsed so as to substantially remove the applied chemicals and the residue. When the substrate surface includes copper, the chemicals are selected from one or a combination of: $NH_4Cl+CuCl_2+HCl$, $(NH_4)_2S_2O_8+H_2SO_4$, $CuCl_2+NH_4Cl+NH_4OH$, $C_6H_8O_7$, $NH_4OH$, $(NH_4)_2HC_6H_5O_7$, HCl, HF, TMAH, SC1, chelating agents, and surfactants.

In yet another embodiment, another method for cleaning a chemical mechanical polishing (CMP) pad is provided. The CMP pad has already been used for performing a CMP operation on a wafer surface and has a residue on a surface of the CMP pad. Chemicals are applied onto the surface of the CMP pad. When the wafer surface is oxide, the chemicals are selected from one or a combination of: $NH_4OH$+hydrogen peroxide ($H_2O_2$)+deionized water (DIW), $NH_4OH$, $C_6H_8O_7$, $(NH_4)_2HC_6H_5O_7$, HCl, HF, TMAH, chelating agents, and surfactants. The chemicals are allowed to react with the residue to produce a by-product. The pad surface is rinsed to substantially remove the by-product and a mechanical conditioning operation is performed on the surface of the pad.

In another embodiment, a chemical mechanical polishing (CMP) system is provided. The CMP system has CMP pad surface that has a residue. The CMP system includes a holding surface, a polishing head, and a chemical dispenser. The holding surface receives the CMP pad. The polishing head holds and applies a wafer to the CMP pad surface. The chemical dispenser uniformly applies a first pad cleaning chemical or a second pad cleaning chemical across the CMP pad surface. The first and second pad cleaning chemicals are configured to react with the residue so as to produce a by-product, substantially removing the residue from the CMP pad surface. When the wafer primarily includes copper, the chemical dispenser will apply the first pad cleaning chemicals. When the wafer primarily includes oxide, the chemical dispenser will apply the second pad cleaning chemicals.

Advantageously, by conditioning a CMP pad in accordance with any one of the embodiments of the present invention, the CMP pad will be able to provide more efficient and cleaner polishing operations over wafer surfaces (e.g., metal and oxide surfaces). Furthermore, because the wafers placed through a CMP operation using a well conditioned pad are cleaner, subsequent wafer cleaning operations will also yield improved cleaning parameters. As a result of the improved CMP and cleaning operations, the wafers and resulting integrated circuit devices may also be of higher quality and, therefore, more reliable. Other aspects and advantages of the present invention will become apparent from the following detailed description, taken in conjunction with the accompanying drawings, illustrating by way of example the principles of the present invention.

BRIEF DESCRIPTION OF THE DRAWINGS

The present invention will be readily understood by the following detailed description in conjunction with the accompanying drawings. To facilitate this description, like reference numerals designate like structural elements.

DETAILED DESCRIPTION

An invention for methods and systems for conditioning CMP pads is disclosed. In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to unnecessarily obscure the present invention.

Figure 1:
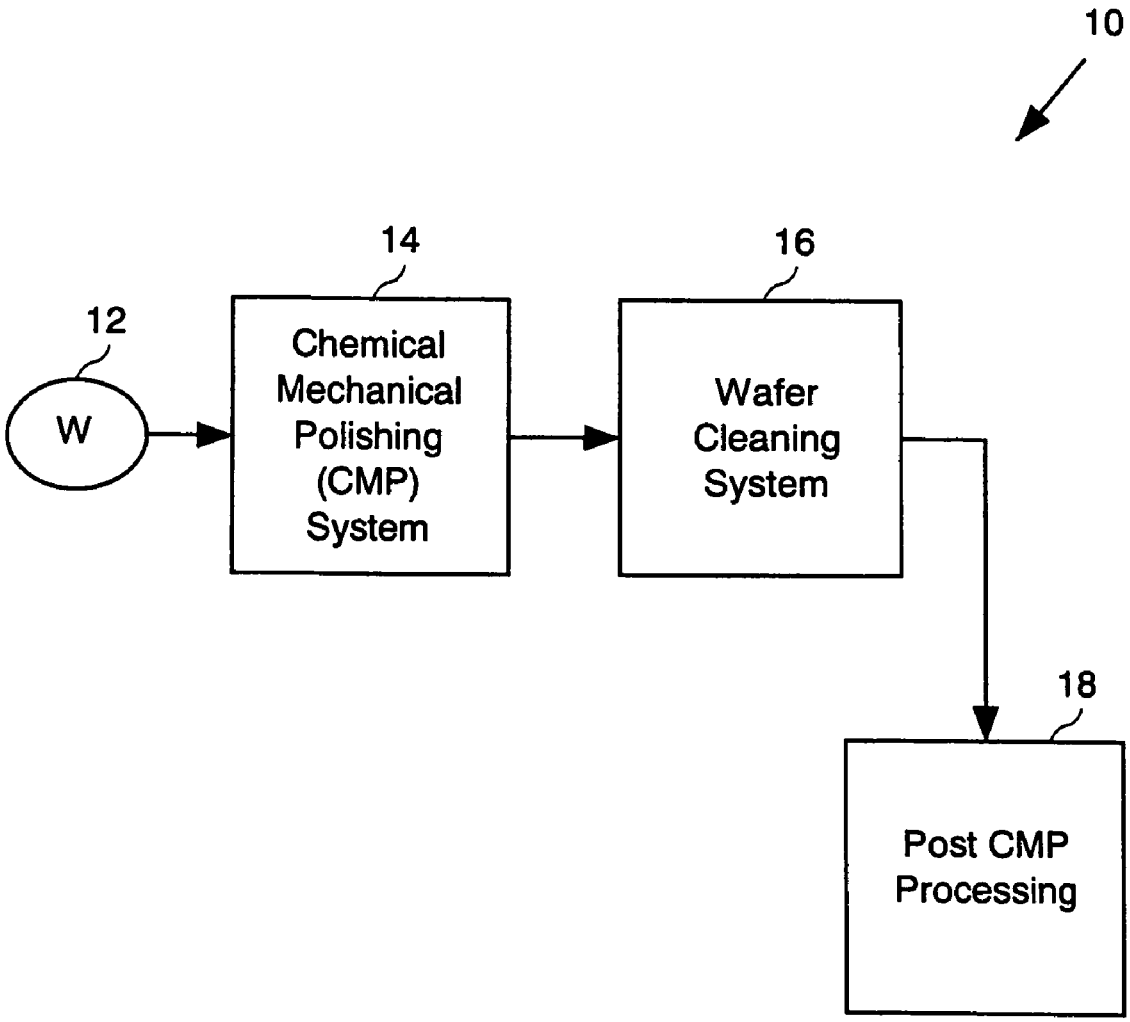
FIG. 1 (prior art)
FIG. 1 shows a schematic diagram of a chemical mechanical polishing (CMP) system, a wafer cleaning system, and post-CMP processing.
Figure 2:
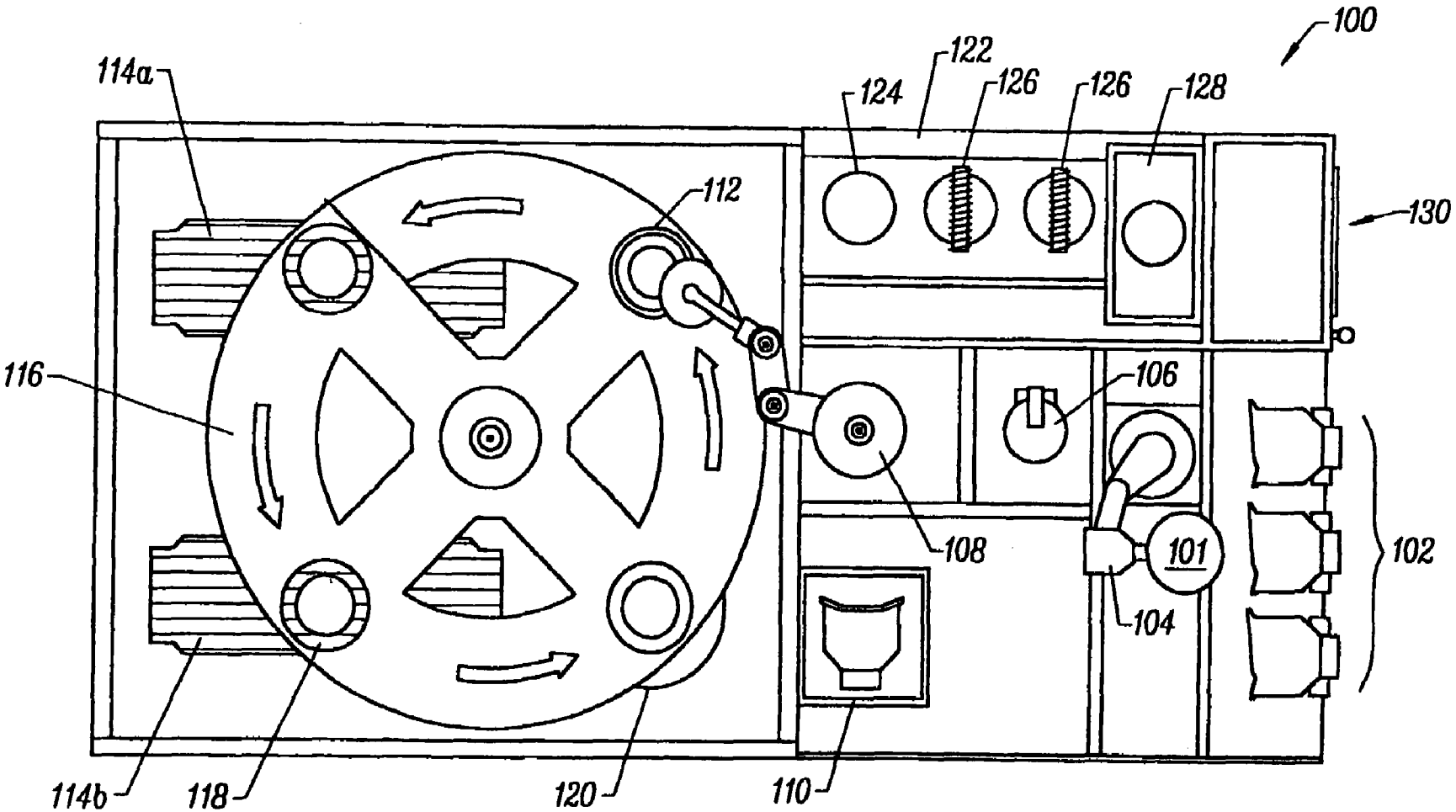
FIG. 2 shows a top-down view of a CMP and cleaning unit, in accordance with one embodiment of the present invention.

FIG. 2 shows a top-down view of a CMP and cleaning unit 100 in accordance with one embodiment of the present invention. A user may set parameters and monitor operations of the CMP and cleaning unit 100 by way of a controlling computer system having a graphical user interface 130.

Figure 3A:
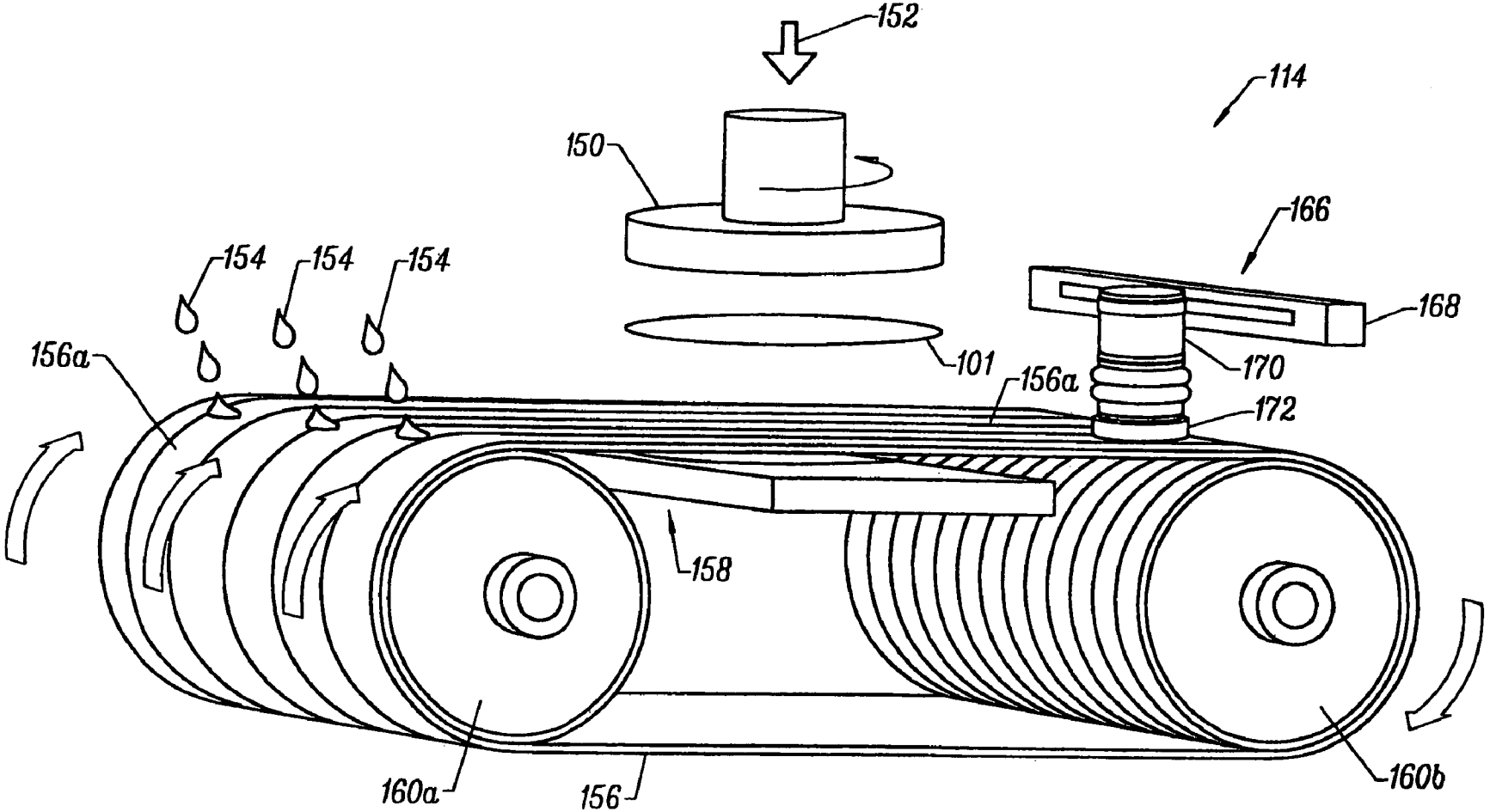
FIG. 3A shows an enlarged view of a CMP system, in accordance with one embodiment of the present invention.

Wafer cassettes 102 preferably containing at least one semiconductor wafer 101 may be provided to the CMP and cleaning unit 100. A dry robot 104 may then transfer the wafer 101 to a pre-aligner 106 where the wafer 101 is properly aligned for subsequent handling. The wet robot 108 may then transfer the wafer 101 from the pre-aligner 106 to a load/unload to a dial plate 116. A polishing head (not shown) may be used to hold the wafer 101 when the wafer is placed over the polishing pads of the CMP systems. The dial plate 116 is used to rotate the wafer 101 to subsequent CMP and cleaning locations. For instance, the dial plate 116 may be used to rotate the wafer to a first CMP system 114*a*, where the wafer 101 is loaded onto the polishing head. The polishing head secures the wafer 101 in place as the wafer 101 is lowered onto a linear belt polishing pad that is part of the first CMP system 114*a*. FIG. 3A, as discussed below, provides a more detailed view of the CMP system 114. The wafer 101 may thus undergo a CMP operation in the first CMP system 114*a* to remove a desired amount of material from the surface of the wafer 101. Although linear belt polishing systems 114 are described herein, it should be understood by one of ordinary skill in the art that an orbital polishing pad that rotates in a circular-type motion may alternatively be used.

After the wafer undergoes a CMP operation in the first CMP system 114*a*, the wafer 101 may be transferred by the dial plate 116 to an advanced polishing head 118 in a second CMP system 114*b*, where the wafer undergoes additional CMP operations. The wafer 101 may then be transferred to the advanced rotary module 120, where the wafer 101 may undergo pre-cleaning operations. In this example, the advanced rotary module 120 implements a soft orbital pad surface. The wafer 101 may then be loaded into a load station 124 in a wafer cleaning system 122. The wafer cleaning system 122 is generally used to remove unwanted slurry residue left over from CMP operations in the CMP systems 114. The unwanted residue may be brushed away by operations in the brush boxes 126.

Each of the brush boxes 126 includes a set of PVA brushes that are very soft and porous. Therefore, the brushes are capable of scrubbing the wafer clean without damaging the delicate surface. Because the brushes are porous, they are also able to function as a conduit for fluids that are to be applied to the wafer surface during cleaning. These cleaning operations typically implement chemicals as well as deionized (DI) water. By way of example, SC1, water, citric acid ($C_6H_8O_7$), ammonium hydroxide ($NH_4OH$), ammonium citrate ($(NH_4)_2HC_6H_5O_7$), hydrochloric acid (HCl), hydrofluoric acid (HF), or Tetramethylammonium Hydroxide (TMAH), alone or in combination, can be applied to the wafer surface during cleaning. According to one embodiment, the SC1 solution implemented is approximately one $NH_4OH$, four parts peroxide ($H_2O_2$), and twenty part $H_2O$, by volume. Of course, the concentration of the components in the SC1 solution may be varied depending upon the specific application. Furthermore, the SC1 solution is applied for a predetermined amount of time. The amount of time the SC1 scrubbing process is applied can be adjusted. For instance, the SC1 solution may be dispensed through the brush for a variable length of time. In another embodiment, chelating agents, surfactants, or chemical mixtures can be implemented to clean wafer surface.

For more information on wafer cleaning systems and techniques, reference may be made to commonly owned U.S. Pat. No. 5,858,109 issued on Jan. 12, 1999, entitled "Method And Apparatus For Cleaning Of Semiconductor Substrates Using Standard Clean 1 (SC1)," and U.S. Pat. No. 5,806,106 issued on Sep. 15, 1999, entitled "Method and Apparatus for Chemical Delivery Through the Brush." Both United States Patents are hereby incorporated by reference.

A spin station 128 may be used to finalize the cleaning operations of the wafer 101. The wafer 101 may then be transferred to the wet queue 110, where the wafer 101 awaits to be transferred to post-CMP processing.

FIG. 3A shows an enlarged view of a CMP system 114 according to one embodiment of the present invention. A polishing head 150 may be used to secure and hold the wafer 101 in place during processing. A linear belt polishing pad 156 is preferably secured to a thin metal belt (not shown), which forms a continuous loop around rotating drums 160*a* and 160*b*. The linear belt polishing pad 156 may be secured to the metal belt by using a well-known glue or other adhesive material. The linear belt polishing pad 156 itself is preferably made of a polyurethane material. The linear belt polishing pad 156 generally rotates in a direction indicated by the arrows at a speed of about 400 feet per minute. As the belt rotates, polishing slurry 154 may be applied and spread over the surface 156*a* of the linear belt polishing pad 156. The polishing head 150 may then be used to lower the wafer 101 onto the surface 156*a* of the rotating linear belt polishing pad 156. In this manner, the surface of the wafer 101 that is desired to be planarized is substantially smoothed.

In some cases, the CMP operation is used to planarize materials such as oxide, and in other cases, it may be used to remove layers of metallization. The rate of planarization may be changed by adjusting the polishing pressure 152. The polishing rate is generally proportional to the amount of polishing pressure 152 applied to the linear belt polishing pad 156 against the polishing pad stabilizer 158. After the desired amount of material is removed from the surface of the wafer 101, the polishing head 150 may be used to raise the wafer 101 off of the linear belt polishing pad 156. The wafer is then ready to proceed to the advanced polishing head 118 or to the wafer cleaning system 122.

Better cleaning of the wafer can be achieved in the wafer cleaning system 122 by improving the processes used in the CMP system 114 before the wafer even gets to the wafer cleaning system 122. The CMP system 114 can be improved for the next wafer by conditioning the surface of the linear belt polishing pad 156. Conditioning of the pad may be performed by removing excess slurry and residue build-up from the clogged belt pad. As more wafers are planarized, the belt pad will collect more residue build-up, which can make efficient CMP operations difficult. One method of conditioning the belt pad is to use a polishing pad conditioning system 166. A conditioning head 170 is preferably used to hold (and in some embodiments rotate) a conditioning disk 172 as a conditioning track 168 holds the conditioning head 170. The conditioning track 168 moves the conditioning head 170 back and forth as the conditioning disk 172 scrapes the linear belt polishing pad 156, preferably with a nickel-plated conditioning disk.

The conditioning disk 172 preferably has a nickel-plated diamond grid or a nylon brush over its surface. The diamond grid is preferably used to condition belt pads having a hard surface. The nylon brush is preferably used to condition belt pads having a softer surface. The conditioning of the belt pad may be done in-situ, where the belt pad is conditioned while the belt pad is polishing the wafer, or ex-situ, where the belt pad is conditioned when the belt pad is not polishing a wafer. Unfortunately, although scraping the belt removes slurry and residues, it inevitably wears away the belt pad itself such that about 200 angstroms of belt pad material is removed from the belt during each conditioning operation.

Figure 3B:
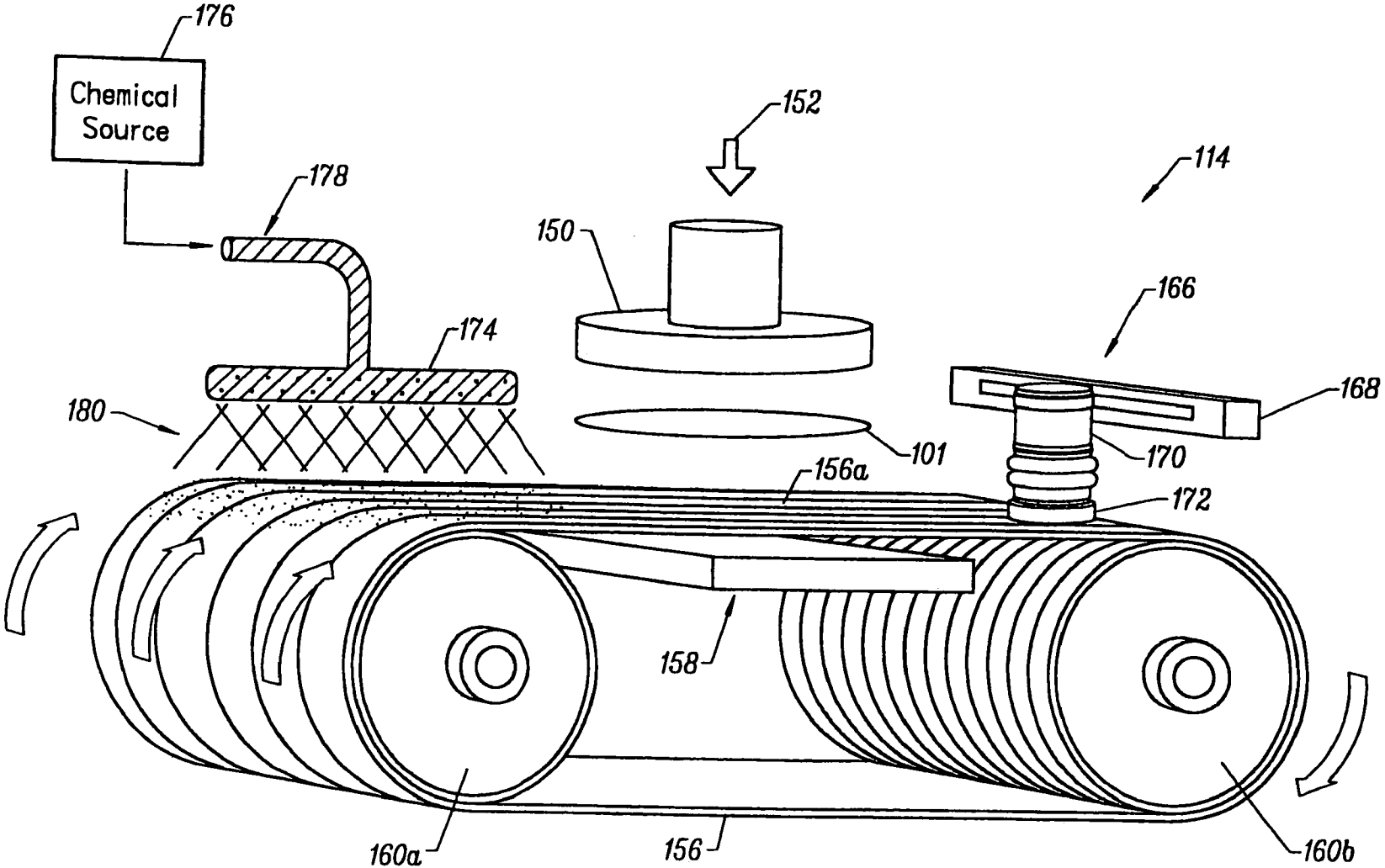
FIG. 3B shows how the cleaning process may be significantly improved by chemically treating a linear belt polishing pad before a conditioning disk is used to scrape the linear belt polishing pad, in accordance with one embodiment of the present invention.

FIG. 3B shows how the cleaning process may be significantly improved by chemically treating the linear belt polishing pad 156 before the conditioning disk 172 is used to scrape the linear belt polishing pad 156, in accordance with one embodiment of the present invention. After a CMP operation has been performed on a wafer and before the linear belt polishing pad 156 is scraped with the conditioning disk 172, a chemical dispenser 174 is preferably used to apply chemicals 180 to the linear belt polishing pad 156 as the belt is rotating. In this embodiment, the chemical dispenser 174 is in the form of a bar having a plurality of holes. The holes are positioned in two or more rows, such that each hole in a row is offset from respective surrounding holes of a next row.

The chemicals 180 are preferably supplied from a chemical source 176, which may be located inside the CMP and cleaning unit 100 or may be located externally. A conduit 178 leading from the chemical source 176 to the chemical dispenser 174 is preferably used to provide the pathway for the chemicals 180 to reach the chemical dispenser 174. In one embodiment, depending on the desired interaction of the chemicals with the materials left on the surface 156*a* after the CMP operation, the chemicals assist in achieving certain advantageous results. For example, the chemicals can react with and substantially dissolve the residue of the materials removed from wafer 101 and the slurry used in the CMP operation. As mentioned above, the CMP operation polishes material from the wafer 101, thereby leaving wafer material residue on the surface 156*a* of the linear belt polishing pad 156. After the chemicals react with the residue, substantially all of the resulting film on the surface 156*a* may be rinsed away with a rinsing liquid, which is preferably DI water. The result is a linear belt polishing pad 156 that has been chemically treated before being conditioned and made ready for another CMP operation on a next wafer.

The additional operation of chemically treating the linear belt polishing pad 156 may provide several advantages over traditional cleaning methods. An additional operation of chemical treatment substantially reduces the amount of pressure and the amount of time needed for applying the wafer to the polishing pad during a subsequent CMP operation because the polishing pad is cleaner and thereby more efficient. With a cleaner polishing pad, the necessary pressure is typically between about 3 and 4 pounds per square inch (psi), and the necessary time for polishing a wafer is typically about 60 seconds. For comparison purposes, if no chemical treating is performed on the pad surface, the time for polishing a subsequently applied wafer is likely to be substantially more at about 2 minutes.

Further, an additional operation of chemical treatment saves a substantial amount of the pad material from being unnecessarily scraped away. As mentioned above, typical conditioning techniques primarily rely on the scraping away of about 200 angstroms of polishing pad material each time conditioning is performed. In a traditional conditioning technique, for example, where chemical treatment is not performed, a hard polishing pad may be usable for about 300 to 500 CMP operations. However, by implementing chemical treatments, as described above, a typical hard polishing pad may be usable for up to about 800-1000 CMP operations. This increase in pad lifetime is primarily due to the fact that the subsequent scraping operation does not have to be so intensive. An extended pad life leads to less downtime for maintenance and repair. Less downtime in turn leads to a significantly lower cost of ownership.

Still further, the chemical treatment of the present invention may safeguard the fabrication system from some of the consequences of over or under-conditioning. If a polishing pad is over-conditioned, the pad will likely not perform as expected, and the material on the surface of the conditioning disk may degrade prematurely. The material over the surface of the conditioning disk may include a diamond grid, which is likely to be very costly to replace. Additionally, through its wearing-out stages, fragments of the diamond grid are likely to shed onto the pad surface and the surface of the wafer. Such unwanted shedding will likely require the entire wafer to be discarded.

On the other hand, if a polishing pad is under-conditioned, unwanted residual material may be left on the polishing pad. It is well-known in the art that it is important that a wafer be adequately cleaned after a CMP operation because of these slurry residues, which may cause damage to the wafer in post-CMP operations or in the operation of a device. The residues may, for example, cause scratching of the wafer surface or cause inappropriate interactions between conductive features. Moreover, a multitude of identical semiconductor chip dies are produced from one semiconductor wafer. One unwanted residual particle on the surface of the wafer during post-CMP processing can scratch substantially all of the wafer surface, thereby ruining the dies that could have been produced from that semiconductor wafer. Such a mishaps in the cleaning operation may be very costly. Accordingly, the chemical treatment operation provides a polishing pad that is in better condition for CMP operations, thereby providing stable removal rate and also reducing the risk of having unwanted particulates and residues left on the wafer in subsequent fabrication processes. Fewer unwanted residues and particulates lead to fewer defective wafers and, thus, an increase in yield.

Chemicals to be applied to the surface 156*a* depend on the type of slurry used during the CMP operation and the type of material polished away from the wafer 101 during the CMP operation. The following discussion discloses various types of fabrication processes and respective preferred chemicals for conditioning the polishing pad.

Figure 4A:
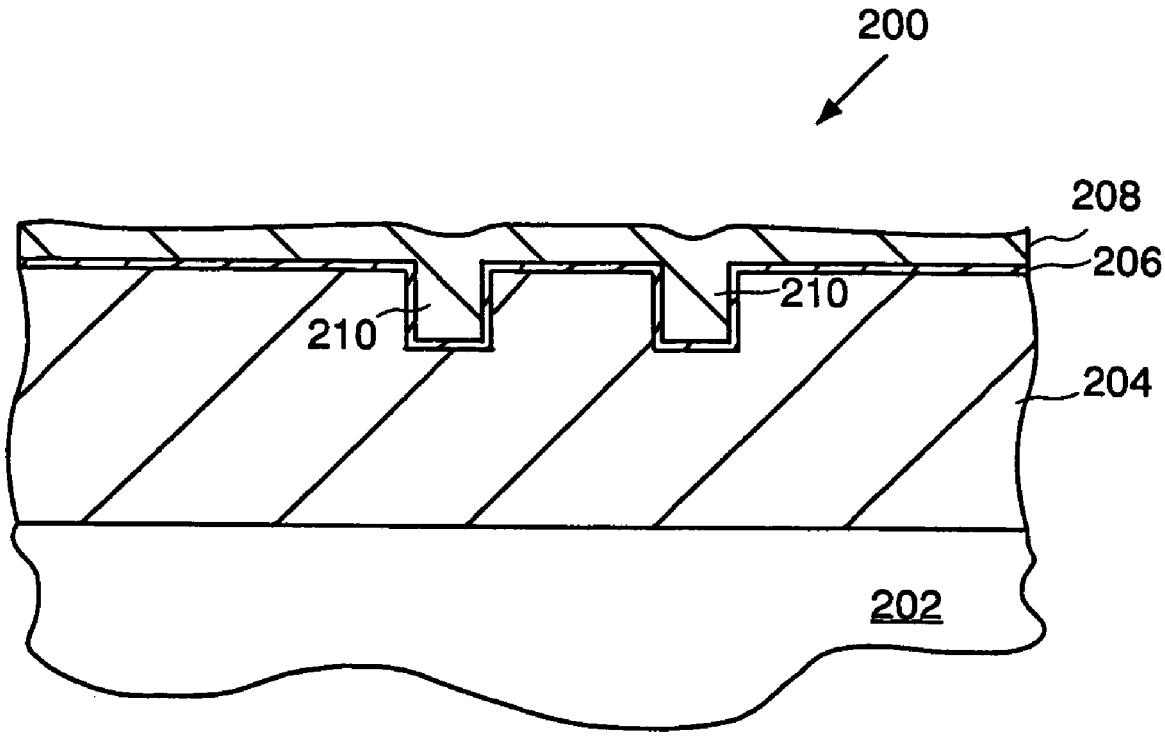
FIG. 4A shows a cross-sectional view of a semiconductor wafer having a copper layer deposited over the top surface of the wafer.

FIG. 4A shows a cross-sectional view of a wafer 200 having a copper layer 208 deposited over the top surface of the wafer 200. An oxide layer 204 is deposited over a semiconductor substrate 202. Well-known photolithography and etching techniques may be used to form patterned features in the oxide layer 204. The top surface of the wafer is then coated with a Ta/TaN layer 206. Next, the top surface of the wafer is coated with a copper layer 208 and the patterned features are thereby filled with copper material 210.

Figure 4B:
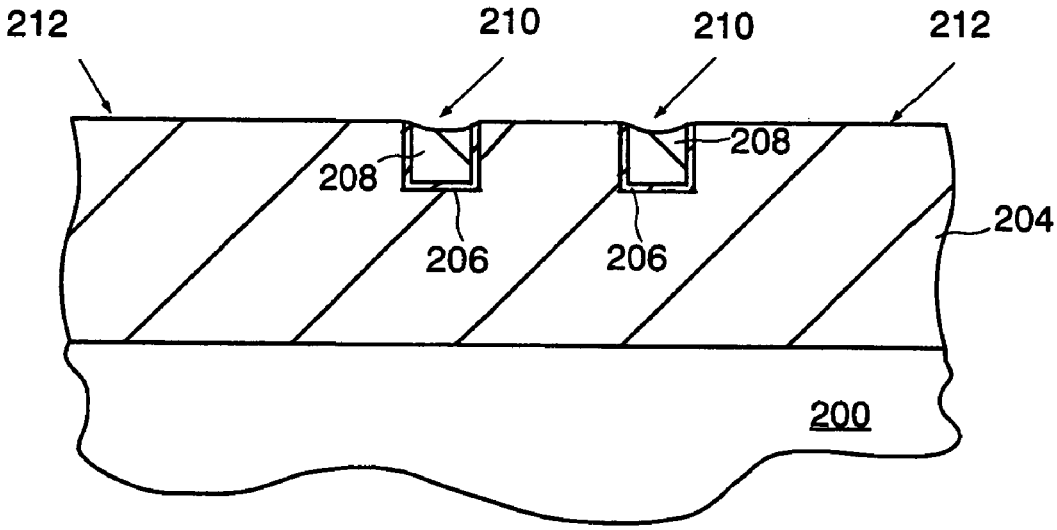
FIG. 4B shows a cross-sectional view of a semiconductor wafer after its top surface has been polished during a CMP operation to form a polished wafer surface.

FIG. 4B shows a cross-sectional view of the semiconductor wafer 200 after the top surface has been polished during a CMP operation to form a polished wafer surface 212. During the actual polishing, polishing slurry 154 is applied to the top surface 156*a* of the linear belt polishing pad 156. Where a CMP operation is to be performed on a metal layer such as copper layer 208, as shown here, the preferred polishing slurry 154 has $Al_2O_3$ abrasive and other chemical components. However, it should be understood by one of ordinary skill in the art that various other chemical compositions of polishing slurry 154 that work with metals such as copper may be used. The wafer 200 is then lowered onto the linear belt polishing pad 156 such that a desired amount of the wafer surface is planarized until the underlying oxide layer 204 is finally exposed.

Figure 4C:
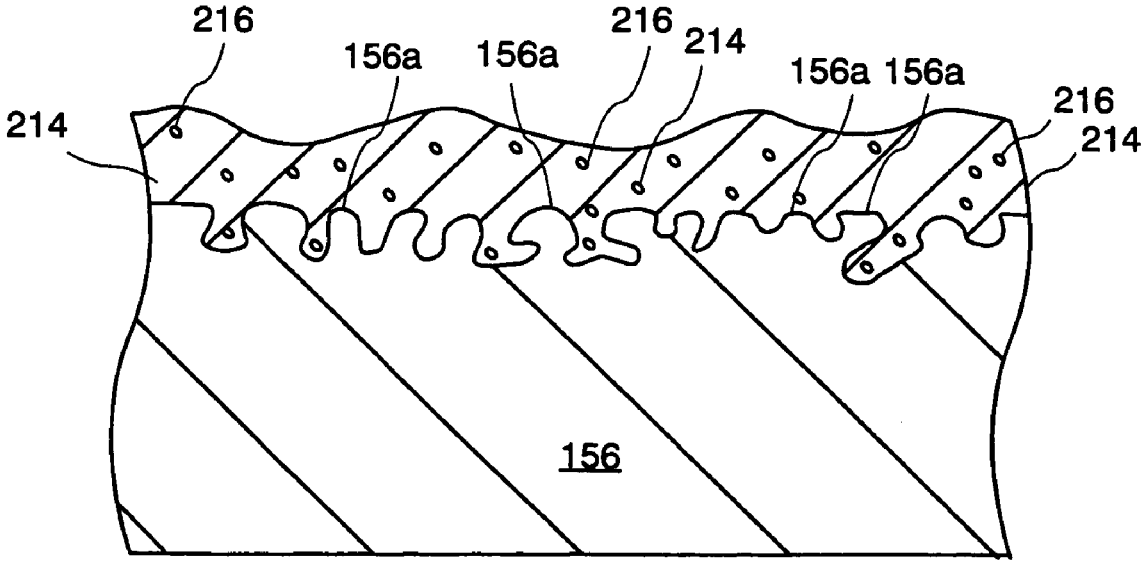
FIG. 4C shows a magnified cross-sectional view of the polishing pad during or after the CMP operation of FIG. 4B.

FIG. 4C shows a magnified cross-sectional view of the linear belt polishing pad 156 after the CMP operation of FIG. 4B. As shown, a residue film 214 of copper material 210 and slurry having particulates 216 clog the surface 156*a* of the linear belt polishing pad 156. In general, the copper material 210 from the wafer 200 combines with the polishing slurry 154 to form the residue film 214 that is in the form of copper oxide ($CuO_x$), and particulates 216. Where the polishing slurry 154 is $Al_2O_3$ based, the particulates are primarily alumina. It is desired that the copper oxide having the embedded particulates 216 are substantially removed from the surface 156*a*.

Figure 5A:
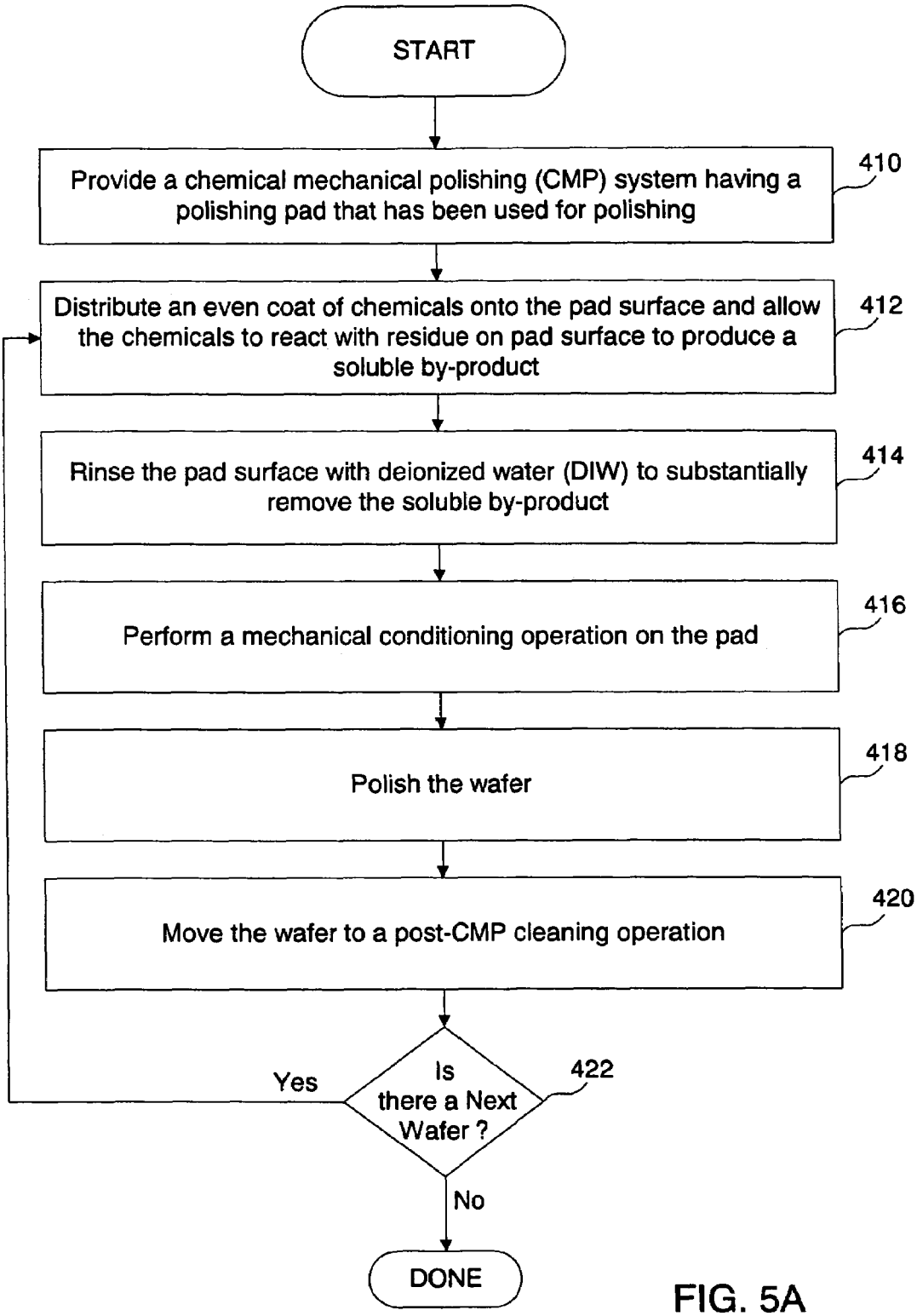
FIG. 5A shows a flow chart of a method for conditioning the linear belt polishing pad after a CMP operation has been performed on a metallization material of the wafer, according to one embodiment of the invention.

FIG. 5A shows a flow chart of a method for conditioning the linear belt polishing pad 156 after a CMP operation has been performed on a metallization material, such as copper, according to one embodiment of the invention. The method starts in operation 410 by providing a CMP system having a polishing pad that has been previously used for polishing metallization material.

The method then moves to operation 412 where an even coat of chemicals is distributed onto the pad surface. In general, it is preferred that the linear belt polishing pad 156 be moving. In one example, the linear belt polishing pad 156 can be traveling at a rate of about 100 feet per minute. After the chemicals are distributed, the chemicals are allowed to react with the residue film 214 on the pad surface to produce a water soluble by-product. The chemicals may be in the form of a solution that contains DI water and hydrochloric acid (HCl). The concentration of HCl in the solution is preferably between about 0.05% and about 1.0% by weight, more preferably between about 0.2% and about 0.8% by weight, and most preferably about 0.5% by weight. The remainder of the solution is preferably DI water. The waiting time for allowing this solution to react with the residue is preferably between about 30 seconds and about 3 minutes, more preferably between about 60 seconds and about 2 minutes, and most preferably about 90 seconds. The chemical reaction that occurs here is likely to be $CuO_x + HCl \rightarrow CUCl_2 + H_2O$, where the by-product $CuCl_2 + H_2O$ is a water soluble material.

Another solution of chemicals contains DI water, $NH_4Cl$, $CuCl_2$, and HCl. The concentration of $NH_4Cl$ is preferably between about 0.5 and about 2.4 moles per liter. The concentration of $CuCl_2$ is preferably between about 0.5 and about 2.5 moles per liter. The concentration of HCl is preferably between about 0.02 and about 0.06 moles per liter. The remainder of the solution is preferably DI water.

Still another solution of chemicals contains DI water, ammonium persulfate ($(NH_4)_2S_2O_8$), and sulfuric acid ($H_2SO_4$). The concentration of $(NH_4)_2S_2O_8$ is preferably between about 0.5 and about 1.0 molar. The concentration of $H_2SO_4$ is preferably between about 0.25 and about 0.5 molar. The remainder of the solution is preferably DI water. The waiting time for allowing this solution to react with the residue is preferably between about 30 and 180 seconds, and most preferably about 60 seconds.

Yet another solution of chemicals contains DI water, copper chloride ($CuCl_2$), ammonium chloride ($NH_4Cl$), and ammonium hydroxide ($NH_4OH$). The concentration of $CuCl_2$ is preferably between about 2 and about 5 grams per liter. The concentration of $NH_4Cl$ is preferably between about 5 and about 10 grams per liter. The concentration of $NH_4OH$, is preferably between about 0.2% and about 0.5% by weight. The remainder of the solution is preferably DI water. The waiting time for allowing this solution to react with the residue is preferably between about 30 and about 180 seconds, and most preferably about 60 seconds.

Of course, one of ordinary skill in the art must appreciate that additional chemicals in the form of solutions may also be applied. For instance, the solution of chemicals can include one or a combination of chemicals such as citric acid, ammonium hydroxide, ammonium citrate, hydrochloric acid, and hydrofluoric acid, chelating agents, SC1, and surfactants.

Next, in operation 414 the pad surface is rinsed with DI water to substantially remove the soluble by-product. A mechanical conditioning operation 416 is then performed on the pad. The conditioning disk 172 may be applied to the surface of the polishing pad at a pressure preferably set between about 1 and about 2 pounds per square inch. At this point, where the pad has been conditioned and prepared to polish a next wafer, the operation moves to operation 418 where a wafer is polished. The polished wafer is subsequently moved to a post-CMP cleaning operation 420. The method now moves to a decision operation 422 where it is determined whether a next wafer is to undergo a CMP operation. If there is not a next wafer, the method is done. However, if there is a next wafer, the method goes back to and continues from operation 412. The foregoing cycle continues until there is no next wafer at decision operation 422.

Figure 5B:
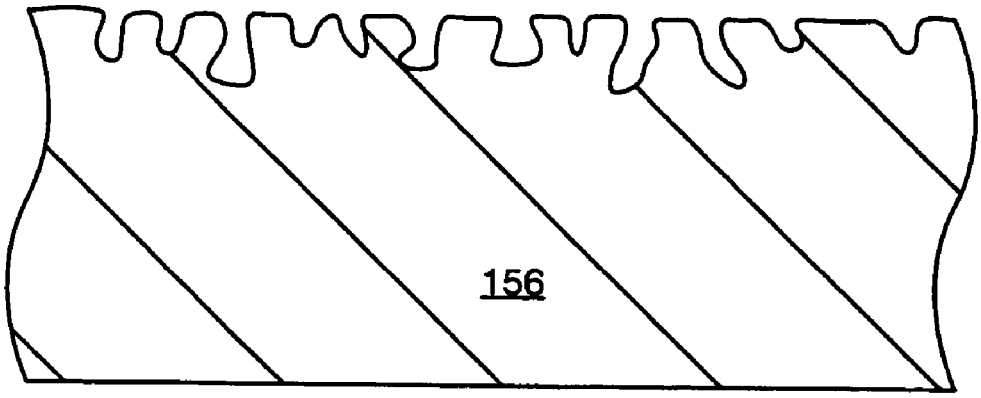
FIG. 5B shows the linear belt polishing pad after the pad surface has been chemically treated and then rinsed with DI water prior to mechanical conditioning and mechanically conditioned to substantially remove residue, such as copper oxide by-products, according to one embodiment of the present invention.

FIG. 5B shows the linear belt polishing pad 156 after the pad surface has been chemically treated in operation 412, rinsed with DI water in operation 414, and mechanically conditioned in operation 416 to substantially remove the residue, according to one embodiment of the present invention.

The foregoing discussion disclosed techniques for removing unwanted materials from a polishing pad where a CMP operation has been performed on metallization material. The following discussion includes disclosure of techniques for cleaning and conditioning a polishing pad where a CMP operation has been performed on dielectric materials or materials that are substantially oxide-based.

Figure 6A:
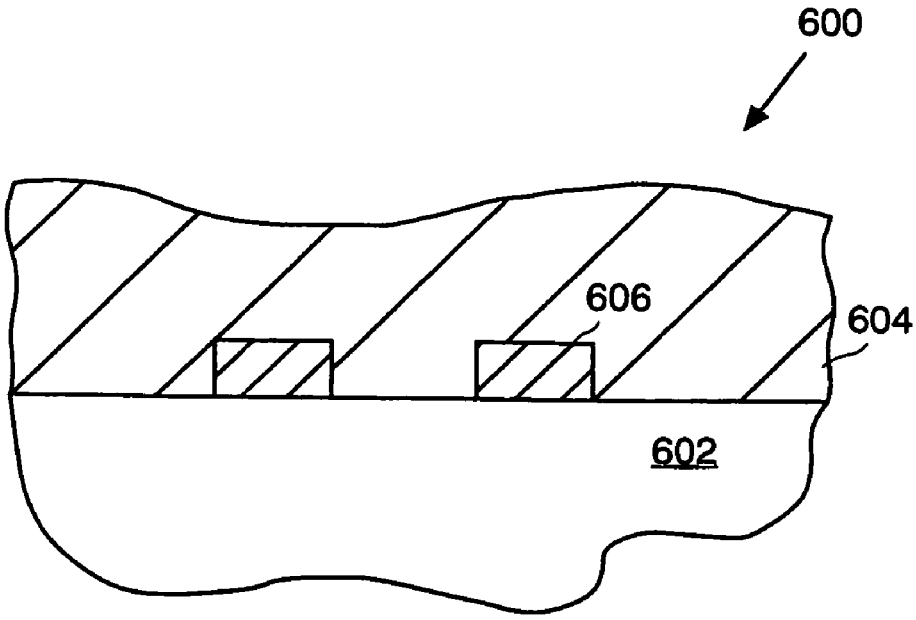
FIG. 6A shows a cross-sectional view of a semiconductor wafer having a dielectric material deposited over the top surface of the wafer.

FIG. 6A shows a cross-sectional view of a wafer 600 having a dielectric material 604 deposited over the top surface of the wafer 600. Well-known photolithography and etching techniques may be used to form patterned metal features 606 over a substrate 602. The top surface of the wafer is generally coated with a dielectric material 604 and the patterned features 606 are completely covered.

Figure 6B:
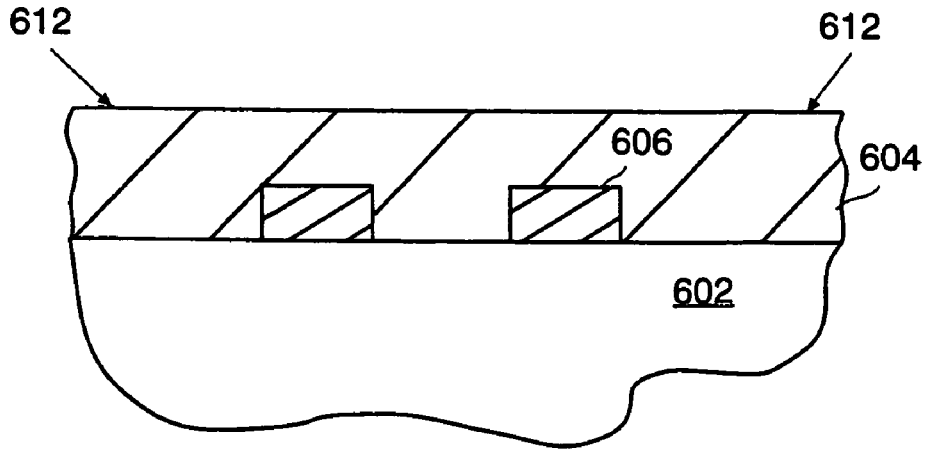
FIG. 6B shows a cross-sectional view of the semiconductor wafer after the top surface has been polished during a CMP operation to form a polished wafer surface.

FIG. 6B shows a cross-sectional view of the semiconductor wafer 600 after the top surface has been polished during a CMP operation to form a polished wafer surface 612. During the actual polishing, polishing slurry 154 is applied to the top surface 156*a* of the linear belt polishing pad 156. Where a CMP operation is to be performed on a dielectric material 604 such as $SiO_2$, as shown here, the preferred polishing slurry 154 has $SiO_2$ as an abrasive component and other chemical components. However, it should be understood by one of ordinary skill in the art that various other chemical compositions of polishing slurry 154 that work with materials such as dielectric material 604 might be used. The wafer 600 is then lowered onto the linear belt polishing pad 156 such that a desired amount of the wafer surface is planarized to form the polished wafer surface 612.

Figure 6C:
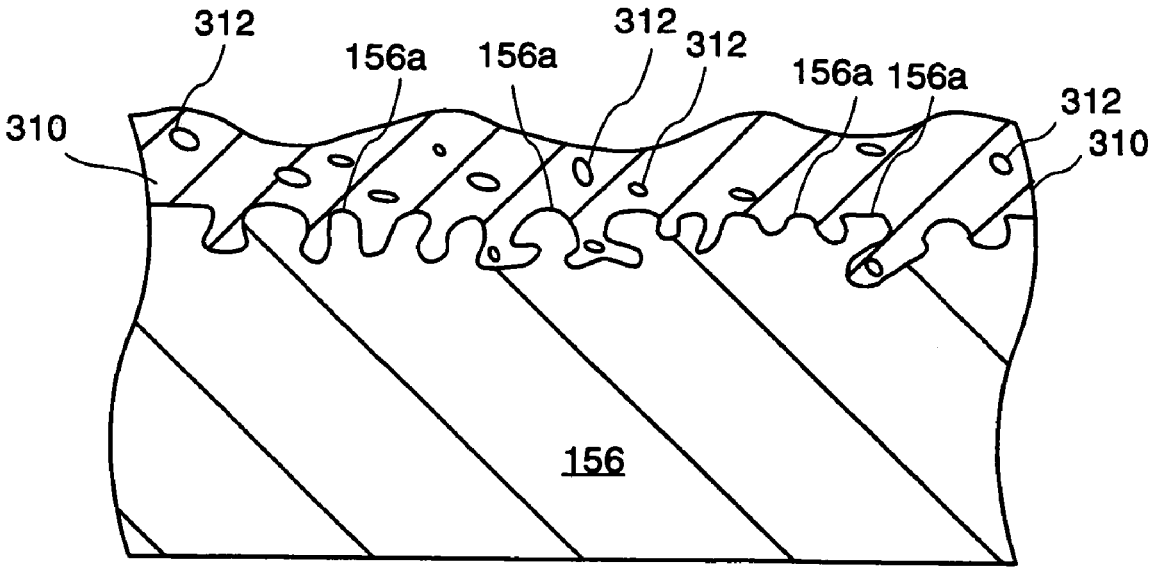
FIG. 6C shows a magnified cross-sectional view of the linear belt polishing pad after the CMP operation of FIG. 6B.

FIG. 6C shows a magnified cross-sectional view of the linear belt polishing pad 156 after the CMP operation of FIG. 6B. As shown, a residue film 310 of dielectric material 604 and abrasive slurry having particulates 312 clog the surface 156*a* of the linear belt polishing pad 156. In general, the dielectric material 604 from the wafer 600 combines with the polishing slurry 154 to form the residue film 310 that is in the form of amorphous silicon dioxide ($SiO_2$) and particulates. Where the polishing slurry 154 is also silicon dioxide based, the particulates are primarily abrasive silicon dioxide. It is desired that the silicon dioxide having the embedded particulates 212 be substantially removed from the surface 156*a* to enable efficient CMP operations.

Figure 7A:
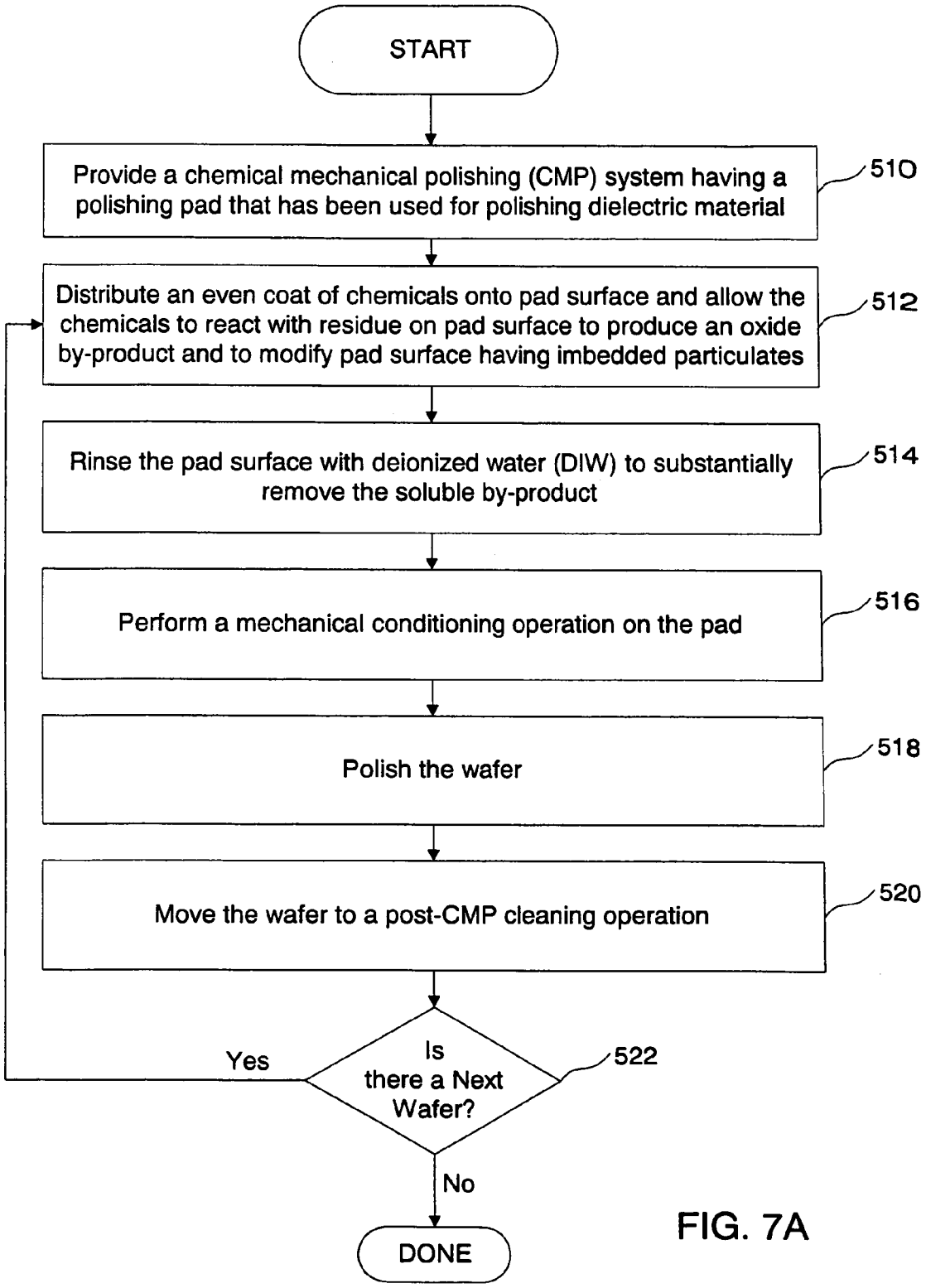
FIG. 7A shows a flow chart of a method for conditioning the linear belt polishing pad after a CMP operation has been performed on a dielectric material, according to one embodiment of the invention.

FIG. 7A shows a flow chart of a method for conditioning the linear belt polishing pad 156 after a CMP operation has been performed on a dielectric material, such as silicon dioxide, according to one embodiment of the invention. The method starts in operation 510 by providing a CMP system having a polishing pad that has been previously used for polishing dielectric material.

The method then moves to operation 512 where an even coat of chemicals is distributed onto the pad surface. After the chemicals are distributed, the chemicals are allowed to react with the residue 310 on the pad surface to produce a soluble by-product and to modify the pad surface having embedded $SiO_2$ particles. The chemicals may be in the form of a solution that contains DI water and ammonium hydroxide ($NH_4OH$). The concentration of $NH_4OH$ in the solution is preferably between about 0.5% and about 2.5% by weight, more preferably between about 0.7% and about 1.5% by weight, and most preferably about 1.0% by weight. The remainder of the solution is preferably DI water. The waiting time for allowing this solution to react with the residue is preferably between about 45 seconds and about 3 minutes, more preferably between about 50 seconds and about 2 minutes, and most preferably about 60 seconds. This solution is preferably allowed to react at about an ambient room temperature of 21 degrees Celsius. By running the method at room temperature, there is advantageously no need for extra mechanical, electrical and control equipment to modify the temperature of the applied solution.

Another solution of chemicals contains DI water, ammonium hydroxide ($NH_4OH$), hydrogen peroxide ($H_2O_2$), and DI water. The concentration of $NH_4OH$ is preferably about 1% by weight. The volume ratio of $NH_4OH$:$H_2O_2$:DI water is preferably about 1:4:20, and most preferably about 1:1:5. The waiting time for allowing this solution to react with the residue is preferably between about 30 and about 180 seconds, and most preferably about 60 seconds. This solution may also be applied to the polishing pad at a heated temperature that is preferably between about 40 degrees Celsius and about 80 degrees Celsius, and most preferably about 60 degrees Celsius.

It must be appreciated by one of ordinary skill in the art that additional chemicals in the form of solutions may also be applied. For instance, the solution of chemicals can include one or a combination of chemicals such as citric acid, ammonium hydroxide, ammonium citrate, hydrochloric acid, hydrofluoric acid, chelating agents, or surfactants.

Operation 512 is followed by operation 514 where the pad surface is rinsed with DI water to substantially remove particulates and the oxide by-product. In general, the residue will be substantially dissolved and substantially removed. Next, a mechanical conditioning operation 516 is performed on the pad. At this point, where the pad has been conditioned and prepared to polish a wafer, the operation moves to operation 518 where a wafer is polished. The polished wafer is subsequently moved to a post-CMP cleaning operation 520. Next, the method moves to a decision operation 522 where it is determined whether a next wafer is to undergo a CMP operation. If there is not a next wafer, the method is done. However, if there is a next wafer, the method goes back to and continues from operation 512. The foregoing cycle continues until there is no next wafer at decision operation 522.

Figure 7B:
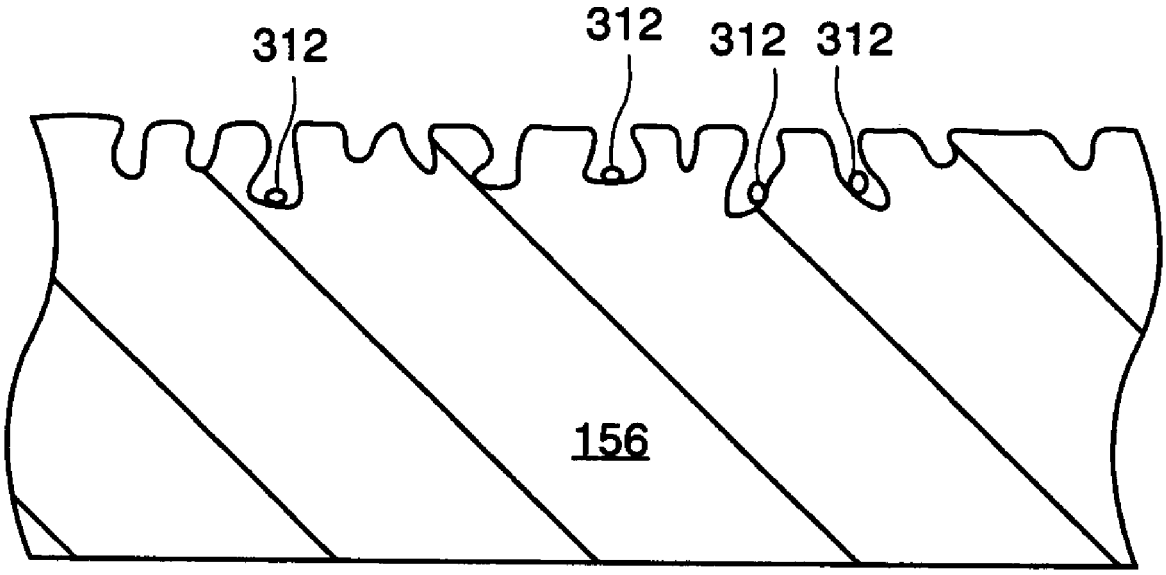
FIG. 7B shows the linear belt polishing pad after the pad surface has been chemically treated and then rinsed with DI water to substantially remove the oxide by-product, according to one embodiment of the present invention.

FIG. 7B shows the linear belt polishing pad 156 after the pad surface has been rinsed with DI water to substantially remove the oxide by-product, according to one embodiment of the present invention. After rinsing with DI water, a substantially small number of unwanted slurry particulates 312 may be left on the surface 156*a* of the linear belt polishing pad 156. These unwanted particulates 312 may be substantially removed by the mechanical conditioning operation 516. As mentioned above, a conditioning disk 172 can be used to perform the conditioning.

It should be understood that although specific reference has been made to belt-type CMP machines, the conditioning methods of the present invention could be applied to other types of CMP machines, such as those that implement rotary mechanisms with round pads. Thus, by implementing these pad conditioning methods, the complete CMP and cleaning operations will generate a higher yield of quality planarized and cleaned metal and oxide surfaces.

While this invention has been described in terms of several preferred embodiments, it will be appreciated that those skilled in the art upon reading the preceding specifications and studying the drawings will realize various alterations, additions, permutations, and equivalents thereof. It is therefore intended that the present invention includes all such alterations, additions, permutations, and equivalents as fall within the true spirit and scope of the invention.

What is claimed is:

1. A method for cleaning a chemical mechanical polishing (CMP) pad after performing a CMP operation on a wafer, the CMP pad having a residue on a surface of the CMP pad, the method comprising:

applying chemicals onto the surface of the CMP pad;

rinsing the pad surface to substantially remove by-product produced by the chemicals; and performing a mechanical conditioning operation on the surface of the pad, wherein during the CMP operation the wafer surface includes copper and oxide wherein when the wafer surface contains more copper than the oxide, the chemicals are selected from one or a combination of:

(a) ammonium chloride ($NH_4Cl$)+copper chloride ($CuCl_2$)+hydrochloric acid (HCl);

(b) ammonium persulfate ($(NH_4)_2S_2O_8$)+sulfuric acid ($H_2SO_4$);

(c) $CuCl_2$+$NH_4Cl$+ammonium hydroxide ($NH_4OH$);

(d) citric acid ($C_6H_8O_7$);

(e) $NH_4OH$;

(f) ammonium citrate ($(NH_4)_2HC_6H_5O_7$);

(g) HCl;

(h) hydrofluoric acid (HF);

(i) Tetramethylammonium hydroxide (TMAH);

(j) SCl;

(k) chelating agents; and (l) surfactants.

2. A method as recited in claim 1, wherein performing the mechanical conditioning operation includes using a conditioner disk having a nickel-plated diamond grid surface or a nylon brush surface.

3. A method for cleaning a chemical mechanical polishing (CMP) pad after performing a CMP operation on a wafer, the CMP pad having a residue on a surface of the CMP pad, the method comprising:

applying chemicals onto the surface of the CMP pad;

rinsing the pad surface to substantially remove by-product produced by the chemicals; and performing a mechanical conditioning operation on the surface of the pad, wherein during the CMP operation the wafer surface includes copper and oxide wherein when the wafer surface contains more oxide than the copper, the chemicals are selected from one or a combination of:

(m) $NH_4OH$+hydrogen peroxide ($H_2O_2$)+deionized water (DIW);
(n) $NH_4OH$;
(o) $C_6H_8O_7$;
(p) $(NH_4)_2HC_6H_5O_7$;
(q) HCl;
(r) HF;
(s) TMAH;
(t) chelating agents; and
(u) surfactants.

4. A method of cleaning a chemical mechanical polishing (CMP) pad, the CMP pad having a residue on a surface of the CMP pad as a result of performing a CMP operation on the surface of a substrate, the surface of the substrate including substantially all copper at a beginning of the CMP operation and a combination of oxide and copper near a completion of the CMP operation after a portion of the copper is removed using the CMP operation, the method comprising:

applying chemicals onto the surface of the CMP pad; and rinsing the pad surface to substantially remove the applied chemicals and the residue, wherein when the surface of the substrate includes more copper than oxide during the CMP operation, the chemicals are selected from one or a combination of:

(a) $NH_4Cl$+$CuCl_2$+HCl;
(b) $(NH_4)_2S_2O_8$+$H_2SO_4$;
(c) $CuCl_2$+$NF_4Cl$+$NH_4OH$;
(d) $C_6H_8O_7$;
(e) $NH_4OH$;
(f) $(NH_4)_2HC_6H_5O_7$;
(g) HCl;
(h) HF;
(i) TMAH;
(j) SCl;
(k) chelating agents; and
(l) surfactants; and wherein when the surface of the substrate is more oxide than copper, the chemicals are selected from one or a combination of:

(m) $NH_4OH$+hydrogen peroxide ($H_2O_2$)+deionized water (DIW);
(n) $NH_4OH$;
(o) $C_6H_8O_7$;
(p) $(NH_4)_2HC_6H_5O_7$;
(q) HCl;
(r) HF;
(s) TMAH;
(t) chelating agents; and
(u) surfactants.

5. A method as recited in claim 4, further comprising:

performing a mechanical conditioning operation on the surface of the pad.

* * * * *